US008814629B2

(12) United States Patent
Johnston

(10) Patent No.: US 8,814,629 B2
(45) Date of Patent: Aug. 26, 2014

(54) NON-ROLLABLE TO ROLLABLE TRANSFORMING TOY

(76) Inventor: Andrew Lewis Johnston, Redwood City, CA (US)

( * ) Notice: Subject to any disclaimer, the term of this patent is extended or adjusted under 35 U.S.C. 154(b) by 138 days.

(21) Appl. No.: 13/523,788

(22) Filed: Jun. 14, 2012

(65) Prior Publication Data

US 2012/0329365 A1 Dec. 27, 2012

Related U.S. Application Data

(60) Provisional application No. 61/499,641, filed on Jun. 21, 2011.

(51) Int. Cl.
*A63H 33/00* (2006.01)
*A63H 17/00* (2006.01)
*A63H 33/26* (2006.01)

(52) U.S. Cl.
CPC ..... *A63H 33/003* (2013.01); *A63H 17/00* (2013.01); *A63H 33/26* (2013.01)
USPC ..... 446/487; 446/409; 446/431; 473/569; 273/359

(58) Field of Classification Search
USPC ..... 446/431, 409, 487, 269–294, 470, 446/129–139; 473/569, 577, 587, 588, 595; 273/359, 108, 126 R, 129 R
See application file for complete search history.

(56) References Cited

U.S. PATENT DOCUMENTS 3,220,744 A * 11/1965 Gomory et al. ..... 180/65.1
3,658,338 A 4/1972 Wheelock
3,798,833 A 3/1974 Campbell
3,873,119 A * 3/1975 Koch ..... 280/47.131
4,057,929 A * 11/1977 Ogawa ..... 446/90
4,218,062 A * 8/1980 Brooks, Jr. ..... 273/108
4,261,136 A * 4/1981 Tsui ..... 446/238
4,599,077 A * 7/1986 Vuillard ..... 446/85
5,131,882 A * 7/1992 Kiyokane ..... 446/464
5,310,378 A * 5/1994 Shannon ..... 446/268
5,467,985 A * 11/1995 Jones ..... 273/126 R
5,518,238 A * 5/1996 Hu et al. ..... 473/589
5,628,512 A * 5/1997 Chan ..... 273/153 S
5,676,582 A 10/1997 Lin
5,816,571 A * 10/1998 Chen ..... 273/153 S (Continued)

FOREIGN PATENT DOCUMENTS

WO 2012177670 A2 12/2012

*Primary Examiner* — Gene Kim
*Assistant Examiner* — Urszula M Cegielnik
(74) *Attorney, Agent, or Firm* — Patent Law Offices of Michael E. Woods; Michael E. Woods

(57) ABSTRACT

A transformable toy with an alterable exterior structure. The toy is constructed to transform from a non-rollable first shape to a second rollable shape. An interior structure inside the exterior structure includes two or more exterior wall portions that collectively define a sphere, the wall portions moveably coupled relative to each and actuated by a triggering mechanism reactive to a magnetic force that is initiated external to the toy, and a biasing member that effects a force which transitions the wall portions to control the exterior structure—from a non-rollable (e.g., half-sphere or the like) first shape to a rollable (e.g., sphere or the like) second shape. Without initiation of the magnetic force, the first shape is maintained. With initiation of the magnetic force, the first shape transforms to the second shape.

15 Claims, 4 Drawing Sheets

(56) References Cited

U.S. PATENT DOCUMENTS

| | | | | | |
|---|---|---|---|---|---|
| 5,836,584 | A * | 11/1998 | Chen | 273/153 S |
| 5,893,789 | A | 4/1999 | Wu | |
| 5,916,007 | A * | 6/1999 | Maxim | 446/130 |
| 5,947,793 | A * | 9/1999 | Yamakawa | 446/431 |
| 6,099,381 | A * | 8/2000 | Sodeshima | 446/487 |
| 6,231,346 | B1 * | 5/2001 | Sagi-Dolev | 434/295 |
| 6,502,657 | B2 * | 1/2003 | Kerrebrock et al. | 180/218 |
| 6,592,427 | B1 * | 7/2003 | Wilhelm et al. | 446/427 |
| 7,306,504 | B2 * | 12/2007 | Saucier | 446/487 |
| D580,994 | S * | 11/2008 | Johansson et al. | D21/713 |
| D588,654 | S * | 3/2009 | Sato et al. | D21/578 |
| D591,802 | S * | 5/2009 | Sato et al. | D21/578 |
| 7,549,930 | B2 * | 6/2009 | Rice | 473/165 |
| 7,670,204 | B2 * | 3/2010 | Huber | 446/34 |
| 7,727,088 | B2 * | 6/2010 | Neal et al. | 473/422 |
| 7,785,168 | B2 | 8/2010 | Yamada et al. | |
| 7,823,884 | B2 * | 11/2010 | Cantner | 273/153 S |
| 8,298,039 | B2 * | 10/2012 | Liu | 446/465 |
| 8,490,974 | B2 * | 7/2013 | Stolten | 273/153 S |
| 2003/0067131 | A1 * | 4/2003 | Morgan | 280/79.2 |
| 2004/0198159 | A1 | 10/2004 | Xu et al. | |
| 2007/0197124 | A1 | 8/2007 | Sato et al. | |
| 2007/0210540 | A1 | 9/2007 | Moll et al. | |
| 2008/0113800 | A1 * | 5/2008 | Ciavaglia et al. | 463/39 |
| 2009/0124164 | A1 | 5/2009 | Willett | |
| 2010/0252990 | A1 | 10/2010 | Yamada et al. | |
| 2010/0291831 | A1 | 11/2010 | Yamada | |
| 2010/0291832 | A1 | 11/2010 | Sip | |
| 2012/0329365 | A1 | 12/2012 | Johnston | |

* cited by examiner

NON-ROLLABLE TO ROLLABLE TRANSFORMING TOY

CROSS REFERENCE TO RELATED APPLICATIONS

This application claims the benefit of U.S. Provisional Application No. 61/499,641, filed 21 Jun. 2011, the entirety of its contents are expressly incorporated by reference thereto for all purposes.

BACKGROUND OF THE INVENTION

The present invention relates generally to an amusement device, and more specifically, but not exclusively, to a transformable toy reactive to a trigger including a magnetic component.

Historically, there have been toys that have been proposed and that have come into practical use which have brought forth a variety of game effects by means of the action of a magnetic force. For example, there have been toys shaped as a sphere and which, when actuated by a magnetic force, transforms the spherical shape to a second non-spherical shape.

Consumers and manufacturers alike continue to find novel amusement devices that are different in construction, operation, and/or gameplay from existing amusement devices. What is needed is a novel amusement device and method this is different in construction, operation, and/or gameplay from existing amusement devices.

BRIEF SUMMARY OF THE INVENTION

Disclosed is a novel amusement device and method this is different in construction, operation, and/or gameplay from existing amusement devices.

The following summary of the invention is provided to facilitate an understanding of some of technical features related to transformable toys transitioning from a non-rollable format to a rollable format, and is not intended to be a full description of the present invention. A full appreciation of the various aspects of the invention can be gained by taking the entire specification, claims, drawings, and abstract as a whole.

A toy equipped with an exterior truncated spherical shell structure with one flat side, constructed in such a way that it transforms from a non-rollable first shape to a second rollable spherical shape, and an interior truncated spherical structure with one flat side contained within this exterior structure and constrained via a single axis of rotation, and wherein the said exterior structure is endowed with a transformation mechanism that transforms an exterior locking portion and the said exterior structure from the said first shape to the said second shape, and wherein the said interior structure is endowed with a magnetic body that moves by means of a magnetic force that acts from the exterior of the said toy, an interior locking portion that moves simultaneously with the movement of this magnetic body, and a biasing means that effects a force which moves or turns this interior locking portion in a particular direction, and wherein, in the event that a magnetic force does not act from the exterior of the said toy, a locked state of the said interior locking portion, which moved or turned in a particular direction by means of the force of the said biasing means, and the said exterior locking portion is realized, and the first shape of the said exterior structure is thereby maintained, and wherein, on the contrary, in the event that a magnetic force has acted from the exterior of the said toy, the said magnetic body and the said interior locking portion resist the force of the said biasing means and move or turn, the locked state of the said interior locking portion and the said exterior locking portion is thereby released, and the said exterior structure thereby transforms from the said first shape to the said second shape by means of the said transformation means.

A toy includes a housing having a first exterior wall shaped as a first portion of a sphere sectioned by a plane passing through the sphere to form a first planar face, the housing including a cavity within the first portion of the sphere; a sphere-completing structure moveably coupled to the housing and disposed within the cavity, the sphere-completing structure including a second exterior wall including a part shaped as a second portion of the sphere sectioned by the plane passing through the sphere to form a second planar face wherein the first and second portions together are configurable to complete the sphere and wherein the sphere-completing structure is moveable within the cavity between a first position in which the planar faces are substantially parallel with the sphere-completing structure substantially disposed within the cavity and a second position in which the planar faces are substantially parallel with the sphere-completing structure substantially disposed outside the cavity; a biasing system coupled to the housing and to the sphere-completing structure, the biasing system capable of applying a biasing force sufficient to transform the sphere-completing structure from the first position to the second position; and a latching system coupled to the housing and to the sphere-completing structure, the latching system including a first latching mode maintaining the first position against the biasing force and maintaining the second position when the sphere-completing structure is transformed to the second position by the biasing force; wherein the latching system includes an externally-actuable trigger for releasing the first latching mode.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 1 illustrates a partial spherical shell sometimes referred to as an external structure;

FIG. 2 illustrates a partial spherical member assembly sometimes referred to as an internal structure;

FIG. 3 illustrates an embodiment in a glide state capable of moving (e.g., sliding, rolling or the like) over a play surface; and FIG. 4 illustrates the embodiment of FIG. 3 in a spherical state that acts as a ball and may roll over the play surface; and FIG. 5

FIG. 8 illustrates the latching mechanism in an unlatched position responsive to the external disc of magnetic material.

DETAILED DESCRIPTION OF THE INVENTION

Figure 2:
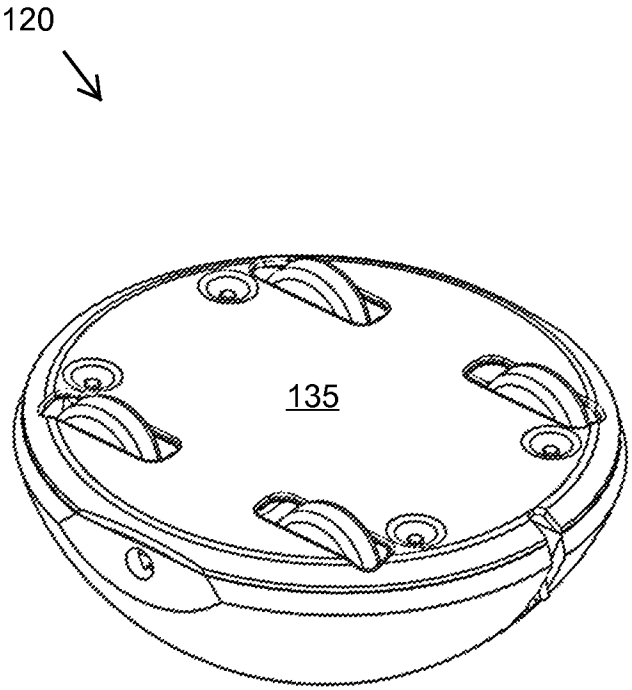
FIG. 1-FIG. 4 illustrates four views for configuration of a transformable toy.

Embodiments of the present invention provide a novel amusement device and method this is different in construction, operation, and/or gameplay from existing amusement devices. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

A preferred embodiment of present invention is a toy that starts in an initial position as a partial sphere with a flat side. The toy has two main parts—one part (e.g., part 1 shown in FIG. 1) includes a shell that constitutes a greater than 50% portion of a sphere (this first part is truncated beyond the midline). The second part (e.g., part 2 shown in FIG. 1) constitutes substantially at least a remainder of the sphere (the sphere portion "truncated" in the first part) so that the two parts may collectively define a complete sphere when the parts are properly oriented to each other. The two parts are joined for relative motion, for example via a hinge, so that they can move (e.g., rotate) with respect to each other. The toy includes an initial state and a spherical state. The initial state has the two parts oriented such that a flat surface of the second part is "face-down" over a play surface with the arcuate portion inside the first part. This flat surface can be simply a relatively\substantially smooth flat surface for sliding\gliding\moving or other non-rolling, non-tumbling position-transforming transition over the play surface, or it can contain any number of wheels or other sliding elements, wheels, bearings, casters, motive elements, and the like to aid in improving transition over the play surface, and in some cases (e.g., wheels), helping to control direction. This second, smaller part is held in this initial state via a latching system, against a biasing force that tends to reposition the two parts relative to each other into the spherical ball state when the latching system enables the biasing force to act. The latching system preferably contains an internal magnetic latch that is actuated via magnetic attraction to a trip element (e.g., either another magnet or a piece of magnetic material (e.g., steel or the like) disposed on/near the play surface). A magnetic force is thus initiated external to the toy from this trip element and causes the latch to release, allowing the two parts to rotate due to the biasing force. The biasing force is sufficient to reposition the two parts to form the spherical shape, with the parts rotating fully and "bottoming out" relative to each other. In this second, spherical shape, the toy can continue moving as a ball by rolling over the play surface. In some implementations, the trip element is a small structure. When the toy engages such a trip element, the trip element is captured by the second part against the flat surface, and will become concealed inside the toy after it completes its transformation to the second shape and continues rolling. When the trip element is too large or integrated into/beneath the play surface, the latch will be triggered without capturing the trip element, and the toy will continue while rolling.

Figure 1:
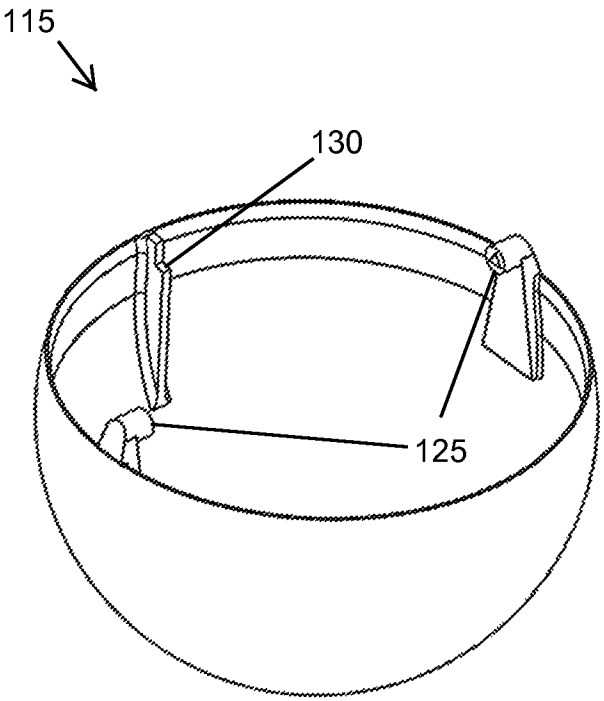
Figure 4:
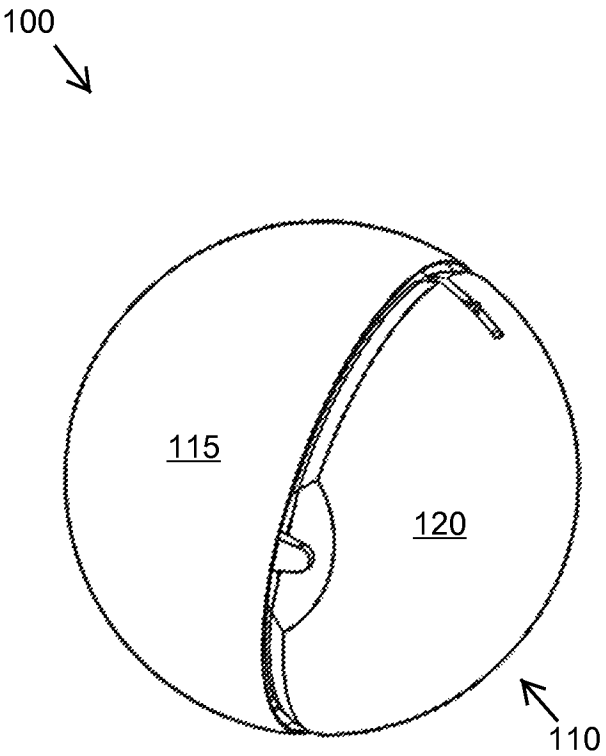
Figure 3:
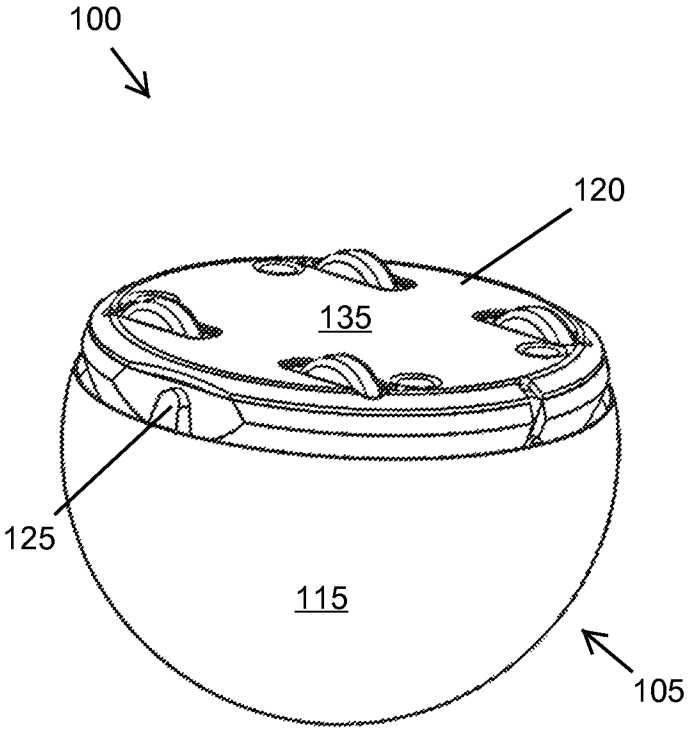

FIG. 1-FIG. 4 illustrates four views for configuration of a transformable toy 100 with toy 100 in a first configuration 105 and a second configuration 110. FIG. 1 illustrates a partial spherical shell sometimes referred to as an external structure or a housing 115; FIG. 2 illustrates a partial spherical member assembly sometimes referred to as an internal structure or a sphere-completing element 120; FIG. 3 illustrates an embodiment in a glide state capable of moving (e.g., sliding, rolling or the like) over a play surface; and FIG. 4 illustrates the embodiment of FIG. 3 in a spherical state that acts as a ball and may roll over the play surface.

The configurations are determined based upon a relative relationship between housing 115 and sphere-completing element 120 moveably coupled to housing 115. Sphere-completing element 120 is coupled to housing 115 at a pair of hinges 125 to allow sphere-completing element 120 to rotate inside housing 115. As explained in more detail herein, housing 115 includes a latch engagement surface 130 to secure sphere-completing element 120 in the glide state of FIG. 3. In a preferred embodiment, housing 115 includes an exterior wall shaped as a first portion of a sphere truncated by a plane produces a dome-like structure with a planar opening), most preferably the exterior wall includes more than a hemisphere. The sphere-completing element 120, at a minimum, includes an exterior portion that substantially matches the truncated portion of housing 115 so collectively they can complete a sphere when properly oriented. Sphere-completing element 120 also includes a dome-like structure with a planar opening, except that in contrast to housing 115, the planar opening is closed.

In a preferred embodiment, housing 115 includes an internal cavity into which sphere-completing element 120 is pivotally mounted about hinges 125 and operates. Sphere-completing element 120 rotates about hinges 125 between a first position producing first configuration 105 (i.e., the glide state) and a second position producing second configuration 110 (i.e., spherical state). While in the first position, a generally planar surface 135 is exposed and in the second position, surface 135 is rotated inside the cavity of housing 115. Toy 100 includes a latching system to maintain sphere-completing element 120 in the first and second configurations.

Surface 135 is preferably optimized for movement over a relatively flat playing surface. Depending upon particular implementations and desired gameplay, surface 135 may be smooth and relatively frictionless to easily glide (e.g., slide, roll with wheels, bearings, casters, pads, and the like) over the playing surface. In some implementations, surface 135 may be provided with one or more motive elements (e.g., wheels, bearings, casters, glidepads, and the like) to provide desired aspects to the moving elements. In some implementations, it is desirable to provide more controllable directional response of toy 100 as it moves over the playing surface in first configuration 105. The four-wheeled option shown is suitable in many cases to provide an acceptable level of directional control. In all cases, the preferred embodiment desirably provides some type of uniform non-rolling/non-tumbling translating motion of toy 100 (for convenience this is referred to herein as "gliding") over the playing surface while in first configuration 105 (with surface 135 generally contacting or disposed proximate to the playing surface). As explained in more detail with respect to FIG. 5-FIG. 8, toy 100 is triggered to transform to second configuration 110 where toy 100 is now able to move over playing surface just as a ball or other spherical toy would do. A height of surface 135 above the playing surface (i.e., how "proximate") is based upon the unlatching mechanism to permit the desired level of reliability in unlatching.

Figure 6:
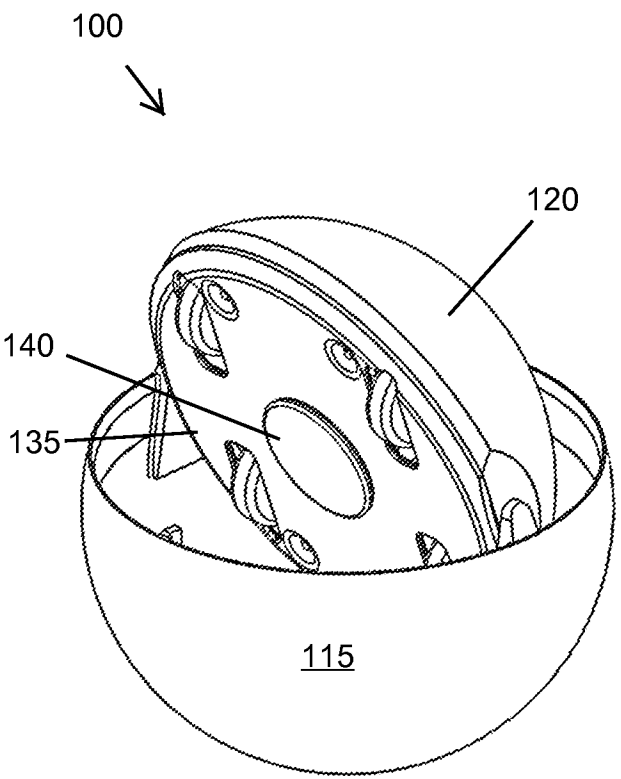
FIG. 6 illustrates release of a latching mechanism permitting relative motion between the external structure and the internal structure.
Figure 5:
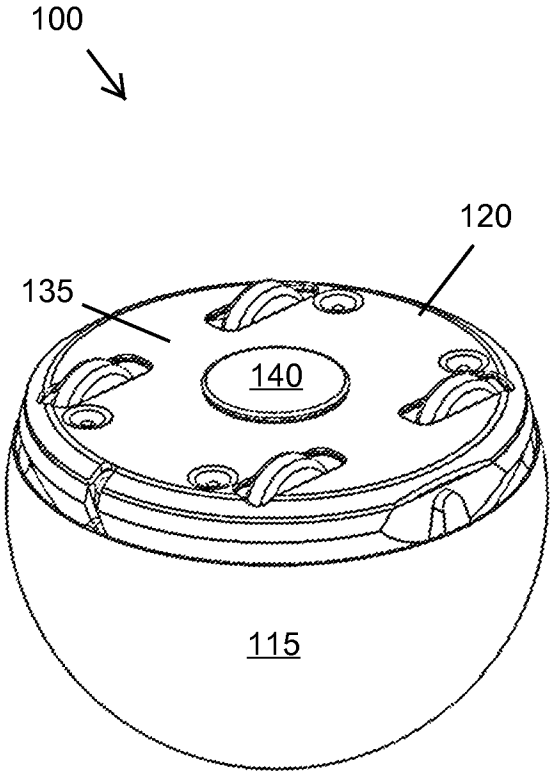
FIG. 5 illustrates the embodiment in contact with an external disc of magnetic material (e.g., ferrous steel, disc magnet, or the like)
Figure 7:
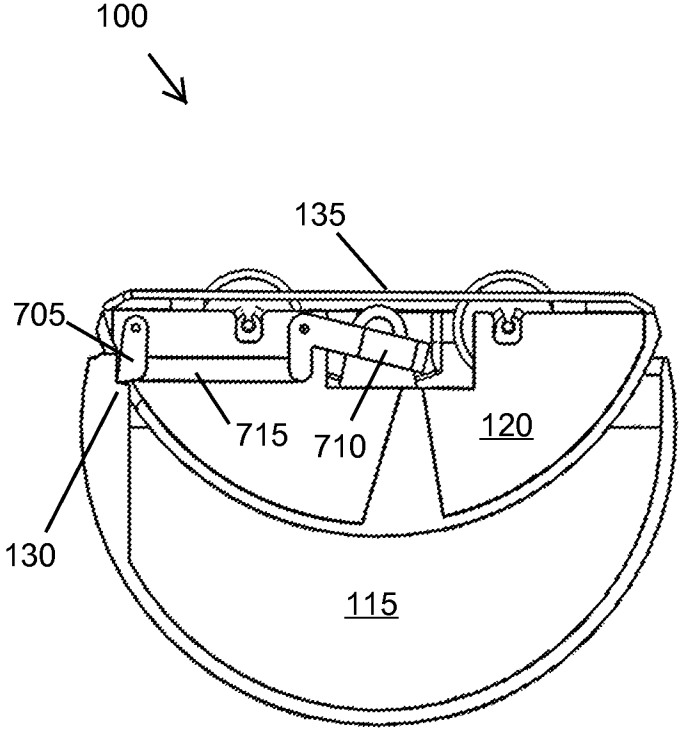
FIG. 7 illustrates the latching mechanism in a latched position.
Figure 8:
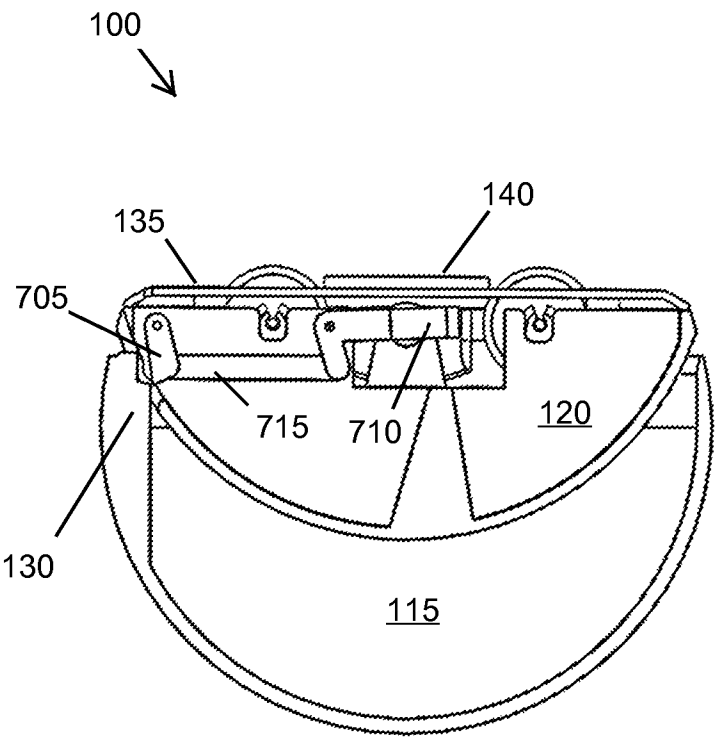
-FIG. 8 illustrates four views for operation of the transformable toy shown in FIG. 1-FIG. 4.

FIG. 5-FIG. 8 illustrates four views for operation of toy 100 shown in FIG. 1-FIG. 4; FIG. 5 illustrates the embodiment in contact with an external disc of magnetic material (e.g., ferrous steel, disc magnet, or the like); FIG. 6 illustrates release of a latching mechanism permitting relative motion between the external structure and the internal structure; FIG. 7 illustrates the latching mechanism in a latched position; and FIG. 8 illustrates the latching mechanism in an unlatched position responsive to the external disc of magnetic material.

Toy 100 is shown in three of the four views in first configuration described in FIG. 1. Four wheels are motive elements disposed on surface 135. Toy 100 includes an externally-actuable latching system and a biasing system that urges sphere-completing element 120 to reposition itself relative to housing 115 from first configuration 105 to second configuration 110. The latching system maintains sphere-completing element 120 in the first position until triggered. At which point, the biasing force repositions housing 115 and sphere-completing element 120 with respect to each other to transition from first configuration 105 to second configuration 110 through operation of the biasing force. The biasing force of some embodiments is used to maintain toy 100 in the spherical state, permitting a user to simply rotate the components relative to each other until back in the glide state, and re-engage the latching mechanism.

The triggering mechanism of toy 100 preferably includes a magnetic component, and most preferably, a magnetic component internal to sphere-completing element 120 responsive to an external magnet or metal reactive to the internal magnet, referred to herein as a triggering element 140. Since surface 135 is preferred to move uniformly over the playing surface, the playing surface may include triggering element 140 (either integrated into the playing surface or disposed on top). In a preferred embodiment, triggering element 140 is a small disk (e.g., steel, another magnet, or the like) reactive with the internal magnet and cooperative with the latching system to release sphere-completing element 120 from the first position. When triggering element 140 includes the small disk, the disk may be strongly attracted to surface 135 and be removeably captured thereto. When captured, the relative motion of sphere-completing element 120 relative to housing 115 results in the small disk being disposed within the cavity of housing 115, and thus within toy 100 as toy 100 continues in the second configuration.

A latch 705 of a latching mechanism of sphere-completing element 120 engages latch engagement surface 130 of housing 115. A spring force holds latch 705 in place and thus toy 100 in the glide state until triggered. The latching mechanism further includes an internal magnet 710 having a linkage 715 to latch 705. When triggering element 140 is disposed sufficiently close to the latching mechanism, internal magnet 710 moves toward triggering element 140 which releases latch 705. Release of latch 705 allows relative movement between housing 115 and sphere-completing element 120 responsive to the biasing force so that toy 100 transitions to the spherical state. Triggering element 140 is captured against surface 135 and rotates inside toy 100 for capture.

In other embodiments, the preferred implementation is not limited to a spherical or near-spherical form factor (e.g., element 120 becomes a "shape-completing" element cooperating with the housing). For example, in some instances it may be desirable or advantageous to implement the invention in a cylinder structure that is circular in two-dimensions rather than three. An elongate partially cylindrical housing formed from a plane forming a face generally parallel to a longitudinal axis of the cylinder defines a cavity into which is disposed another elongate partially cylindrical moveable element that, together with the cylinder housing, collectively defines a cylinder.

In other respects, a collective outer surface of a housing and relatively moving member may be spheroid, ellipsoid, or other surface capable of rolling/tumbling. A plane passing through the surface defines portions of the housing with an interior cavity and a relatively moveable element to interoperate with the housing to having a generally planar surface in one mode and to transition the structures into the collective closed structure. The actual exterior walls of the structures need not be solid but could be mesh or other surface defining structure defining an open or partially open outer surface. In some embodiments, one or more of the housing and shape-completing elements may be made opaque, translucent, and/or transparent. In modes where it is desirable to for the shape-completing element to pick-up and collect the magnetic triggers (e.g., disks and the like which may be illustrated/shaped for further amusement/gameplay), having one or more transparent portions in the housing and/or the shape-completing element permits observation of/interaction with the trigger.

While the shape-completing element is generally described as relatively moveable with respect to an outer housing to complete a sphere (or spheroid, ellipsoid, rollable/tumbleable structure, or the like). Other structures and systems may be implemented to complete the desired shape for the housing besides those described herein. The preferred latching system includes a trigger with a magnetic component. In some implementations, other latching/triggering systems may be used including RF/wireless transceiving systems, timing systems, and other user interactive/controllable mechanisms.

As noted herein, the system and process are most preferably implemented in a transformable toy that transitions from a first configuration that moves non-rollably over a playing surface to a second configuration that moves rollably over the playing surface. The system includes an externally-actuable latching system that is preferably used to capture and retain external magnetic components disposed on the playing surface.

The system and methods above has been described in general terms as an aid to understanding details of preferred embodiments of the present invention. Other preferred embodiments of the present include the described application for amusement systems using the described transformable toy. In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A toy, comprising:

a housing having a first exterior wall shaped as a first portion of a sphere sectioned by a plane passing through said sphere to form a first planar face, said housing including a cavity within said first portion of said sphere;

a sphere-completing structure moveably coupled to said housing and disposed within said cavity, said sphere-completing structure including a second exterior wall including a part shaped as a second portion of said sphere sectioned by said plane passing through said sphere to form a second planar face wherein said first and second portions together are configurable to complete said sphere and wherein said sphere-completing structure is moveable within said cavity between a first position in which said planar faces are substantially parallel with said sphere-completing structure substantially disposed within said cavity and a second position in which said planar faces are substantially parallel with said sphere-completing structure substantially disposed outside said cavity;

a biasing system coupled to said housing and to said sphere-completing structure, said biasing system capable of applying a biasing force sufficient to transform said sphere-completing structure from said first position to said second position; and a latching system coupled to said housing and to said sphere-completing structure, said latching system including a first latching mode maintaining said first position against said biasing force and maintaining said second position when said sphere-completing structure is transformed to said second position by said biasing force; wherein said latching system includes an externally-actuable trigger for releasing said first latching mode.

2. The toy of claim 1 wherein said externally-actuable trigger includes a magnetic element disposed within said cavity.

3. The toy of claim 1 wherein said externally-actuable trigger includes a first magnetic component.

4. A transformable toy configurable to repeatably transition between a glide state and a spherical state, comprising:

a housing having a first exterior domed surface defining a first partial spherical surface having a cavity accessed through a first planar opening in said first exterior domed surface;

a sphere-completing element having a second domed exterior surface coupled to a planar face, sphere-completing element moveably coupled to said housing inside said cavity for a movement of said sphere-completing element within said cavity, said movement configured for a first repeatable transformation of said sphere-completing element between a glide position and a spherical position and said movement further configured for a second repeatable transformation of said sphere-completing element between said spherical position and said glide position, said glide position configured to dispose said planar face outside said cavity with said second domed exterior surface disposed inside said cavity and said spherical position configured to dispose said planar face inside said cavity with said second domed exterior surface disposed outside said cavity wherein said partial spherical surfaces collectively define a substantially spherical surface when said sphere-completing element is disposed in said spherical position;

a latching system, coupled to said sphere-completing element, including a latch maintaining said sphere-completing element in said glide position until a trigger event releases said latch.

5. The transformable toy of claim 4 further comprising:

a biasing system coupled to said housing and to said sphere-completing element, said biasing system configured to apply a biasing force to said sphere-completing element transforming it from said glide position to said spherical position.

6. The transformable toy of claim 4 wherein said sphere-completing element is rotatably coupled to said housing and wherein said repeatable transformations include rotations of said sphere-completing element within said cavity when transitioning between said states.

7. The transformable toy of claim 5 wherein said sphere-completing element is rotatably coupled to said housing and wherein said repeatable transformations include rotations of said sphere-completing element within said cavity when transitioning between said states.

8. The transformable toy of claim 4 wherein said sphere-completing element includes an internal volume defined by said second domed exterior surface and said planar face, further comprising:

a triggering mechanism, disposed within said internal volume, coupled to said latching system, and responsive to a detection of a triggering element disposed outside said internal volume and proximate to said planar face when said sphere-completing element is in said glide position, said detection configured to produce said trigger event to said latching system to release said latch.

9. The transformable toy of claim 7 wherein said sphere-completing element includes an internal volume defined by said second domed exterior surface and said planar face, further comprising:

a triggering mechanism, disposed within said internal volume, coupled to said latching system, and responsive to a detection of a triggering element disposed outside said internal volume and proximate to said planar face when said sphere-completing element is in said glide position, said detection configured to produce said trigger event to said latching system to release said latch.

10. The transformable toy of claim 8 wherein said triggering mechanism includes a first magnetic component and wherein said triggering element includes a second magnetic component magnetically complementary to said first magnetic component.

11. The transformable toy of claim 10 wherein said detection includes said triggering element captured against said planar face by said first magnetic component.

12. The transformable toy of claim 9 wherein said triggering mechanism includes a first magnetic component and wherein said triggering element includes a second magnetic component magnetically complementary to said first magnetic component.

13. The transformable toy of claim 12 wherein said detection includes said triggering element captured against said planar face by said first magnetic component.

14. The transformable toy of claim 4 wherein said planar face includes a plurality of motive elements.

15. The transformable toy of claim 13 wherein said planar face includes a plurality of motive elements.

* * * * *